US007080599B2

(12) United States Patent
Taylor

(10) Patent No.: US 7,080,599 B2
(45) Date of Patent: Jul. 25, 2006

(54) RAILROAD HOPPER CAR TRANSVERSE DOOR ACTUATING MECHANISM

(76) Inventor: Fred J. Taylor, 6485 Rogers Ln., Burlington, KY (US) 41005

( * ) Notice: Subject to any disclaimer, the term of this patent is extended or adjusted under 35 U.S.C. 154(b) by 37 days.

(21) Appl. No.: 10/863,887

(22) Filed: Jun. 8, 2004

(65) Prior Publication Data

US 2004/0244638 A1 Dec. 9, 2004

Related U.S. Application Data

(60) Provisional application No. 60/476,940, filed on Jun. 9, 2003.

(51) Int. Cl.
*B61D 7/02* (2006.01)

(52) U.S. Cl. ..... 105/290; 105/288; 105/289; 105/299

(58) Field of Classification Search ..... 105/288, 105/289, 290, 293, 296, 299, 247, 248, 253, 105/286, 280
See application file for complete search history.

(56) References Cited

U.S. PATENT DOCUMENTS 3,187,684 A 6/1965 Ortner
3,596,609 A 8/1971 Ortner et al.
3,611,947 A 10/1971 Nagy
3,786,764 A 1/1974 Beers, Jr. et al.
3,815,514 A 6/1974 Heap
3,818,842 A 6/1974 Heap
3,949,681 A 4/1976 Miller
4,222,334 A 9/1980 Peterson
4,224,877 A 9/1980 Stark et al.
4,366,757 A 1/1983 Funk
4,601,244 A 7/1986 Fischer
4,628,825 A 12/1986 Taylor et al.
4,741,274 A 5/1988 Ferris et al.
4,766,820 A * 8/1988 Ritter et al. ..... 105/240
5,249,531 A 10/1993 Taylor
5,823,118 A 10/1998 Manstrom
6,019,049 A 2/2000 Gaydos et al.
6,405,658 B1 6/2002 Taylor

* cited by examiner

*Primary Examiner*—Mark T. Le
(74) *Attorney, Agent, or Firm*—Jerrold J. Litzinger

(57) ABSTRACT

An actuating system for operating transverse doors of a railroad hopper car. The mechanism includes an operating member which is coupled to a door or doors of the car by a shaft and a linkage which couples a power source to the operating member, where the operating member rotates to move the door away from the hopper. The mechanism can operate doors which open in opposed direction with a single power source. The mechanism can be used in new car construction, and can be retrofitted onto existing hopper cars.

13 Claims, 11 Drawing Sheets

RAILROAD HOPPER CAR TRANSVERSE DOOR ACTUATING MECHANISM

CROSS REFERENCE TO RELATED APPLICATONS

This application claims benefit from U.S. Provisional Application Ser. No. 60/476,940, filed Jun. 9, 2003, which application is incorporated herein by reference.

BACKGROUND OF THE INVENTION

1. Field of the Invention

The present invention relates generally to an apparatus for opening the rotating doors of a railroad hopper car, and, in particular, to a novel apparatus capable of opening transverse doors on a railroad car.

2. Description of the Prior Art

A common type of railroad freight car in use today is the freight car of the type wherein the load is discharged through hoppers in the underside of the body. Such cars are generally referred to as covered hopper cars and are used to haul coal, phosphate and other commodities.

After hopper cars are spotted over an unloading pit, the doors of the hoppers are opened, allowing the material within the hopper to be emptied into the pit.

Hopper cars, which may be covered, are usually found with one of two hopper configurations: transverse, in which the doors closing the hoppers are oriented perpendicular to the center line of the car; or longitudinal, in which the doors closing the hoppers are oriented parallel to the center line of the car. An example of a hopper car with transverse doors is shown in U.S. Pat. No. 5,249,531, while an example of a hopper car with longitudinal doors is shown in U.S. Pat. No. 4,224,877.

Prior art references which teach operating mechanisms for opening and closing hopper doors include U.S. Pat. Nos. 3,596,609; 4,741,274; 3,187,684; 3,611,947; 3,786,764; 3,815,514; 3,818,842; 3,949,681; 4,222,334; 4,366,757; 4,601,244; 5,823,118; and 5,249,531. There are several disadvantages to the hopper door operating mechanisms described in some of the aforementioned patents. One problem is that some of the prior art mechanisms are designed such that each actuating mechanism is connected to doors from two separate hoppers. Thus, if the mechanism fails, it affects the operation of two hoppers. Another disadvantage of some of the above described hopper door mechanisms is that the operating mechanisms limit the distance of the door motion, thus limiting the open area of the car's bottom. This arrangement slows the unloading process and causes additional costs and potential damage to the car due to increased period in thaw sheds. A further disadvantage of some of the prior art hopper door mechanisms are that they are designed for new railcar construction.

SUMMARY OF THE INVENTION

It is therefore an object of the present invention to provide an automatic mechanism for actuating the discharge doors of a hopper car which can quickly empty the contents.

It is a further object of the present invention to provide an actuating mechanism for hopper car doors which can be used in new car manufacturing as well as can be retrofitted to existing cars.

It is a still further object of the present invention to provide an actuating mechanism for a hopper car with transverse doors that can simultaneously open all of the doors regardless of the direction of opening.

It is also an object of the present invention to provide an operating mechanism for hopper car doors using a single cylinder which can be mounted at either end of the railcar.

It is a still further object of the present invention to provide an actuating mechanism for hopper car doors in which each door assembly has a positive over-center locking feature to securely close the doors.

These and other objects of the present invention will be more readily apparent from the descriptions and drawings which follow.

DESCRIPTION OF THE PREFERRED EMBODIMENTS

Figure 1:
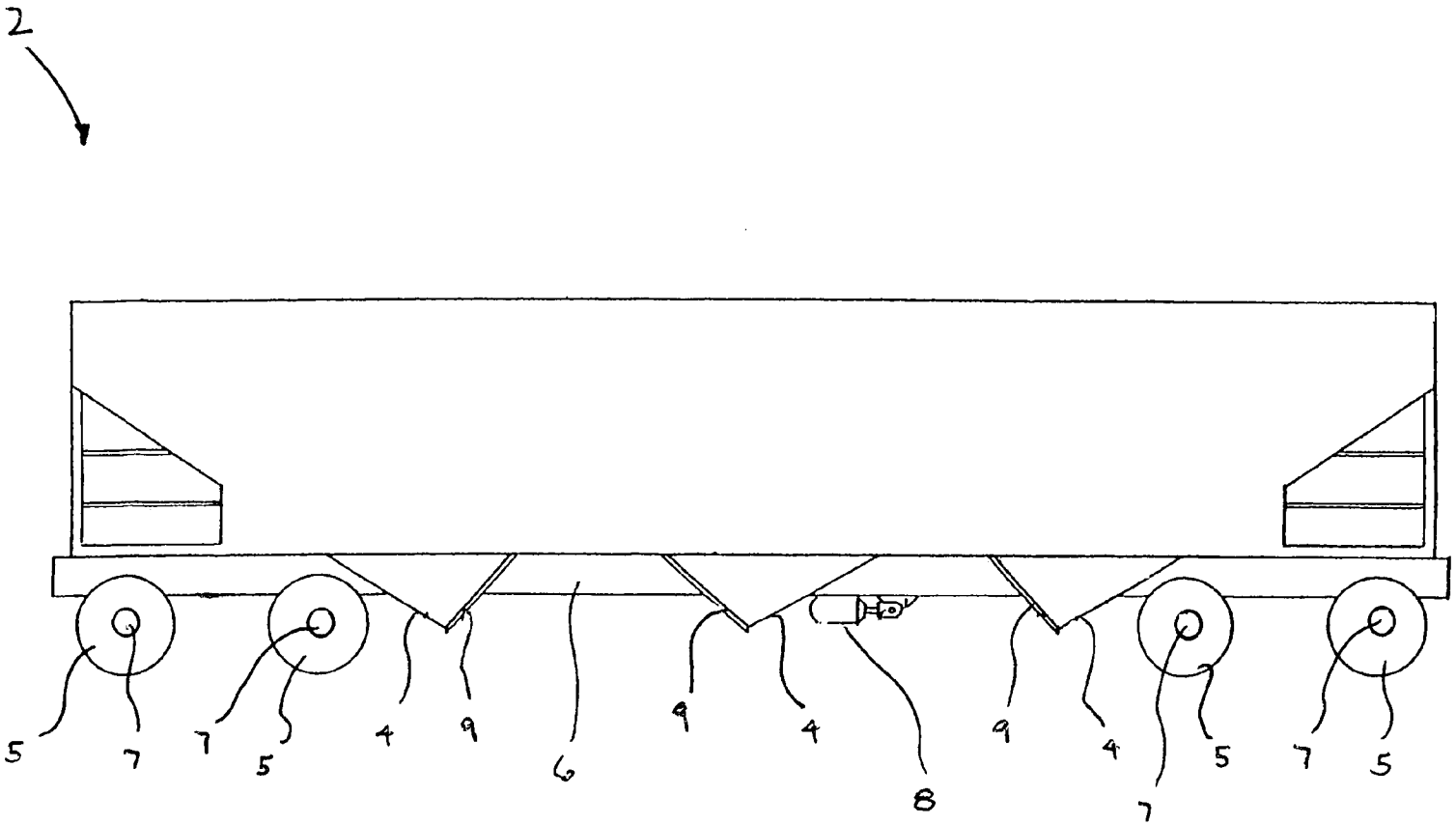
FIG. 1 is an elevational view of a standard three pocket hopper car having transverse doors onto which the door actuating mechanism of the present invention may be incorporated.

Referring now to FIG. 1, there is shown a typical three pocket railway hopper car, generally designated at 2, which may be equipped with a preferred embodiment of the present invention. Car 2 is provided with a plurality of hopper units 4, a plurality of wheels 5, and a longitudinally extending center sill 6. Wheels 5 are mounted on a series of truck axles 7. An air cylinder 8 is mounted to car 2 on the underside of sill 6 to provide power for the mechanism of the present invention. The operation of air cylinder 8 is well known in the art, and it is within the scope of the present invention to use any suitable power source (electric, liquid, steam) to operate cylinder 8. Each hopper unit 4 is provided with a door 9 which is moveable to open and close each hopper unit 4.

Figure 2:
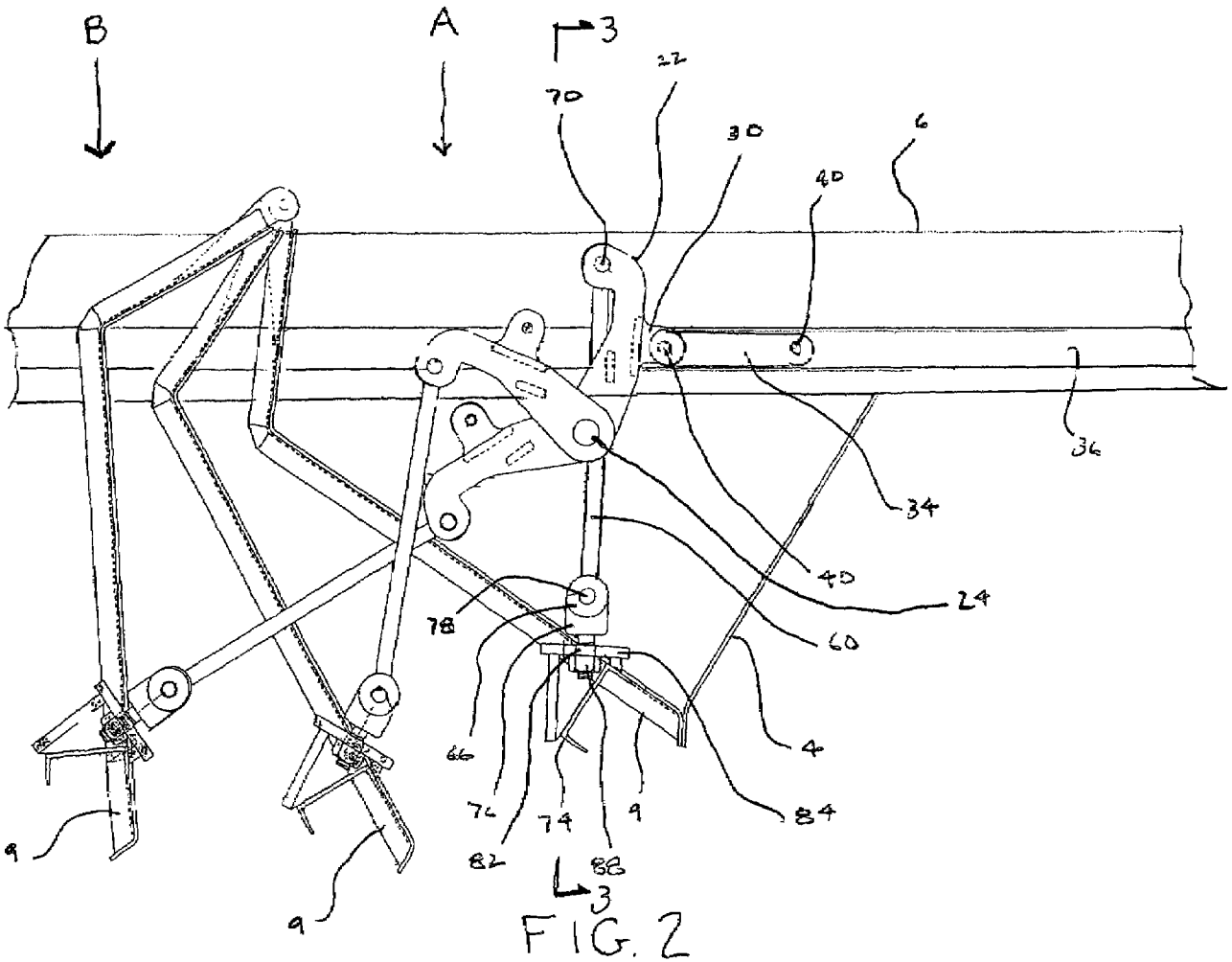
FIG. 2 is a fragmentary elevational view, taken along a longitudinal axis of a railroad hopper car having transverse doors, showing the actuating mechanism of the present invention in different stages of operation.
Figure 3:
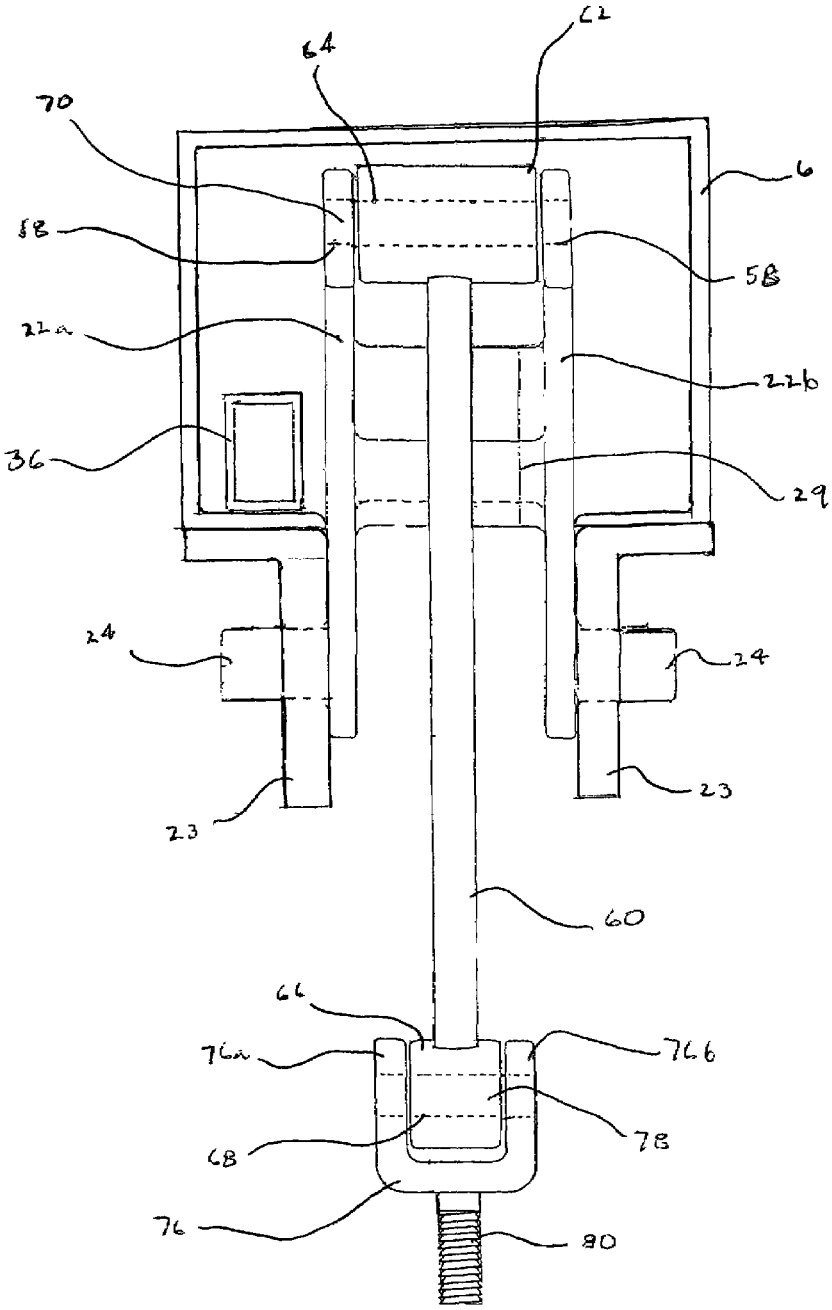
FIG. 3 is a sectional view of the door actuating mechanism of the present invention taken along line 3—3 of FIG. 2.
Figure 8A:
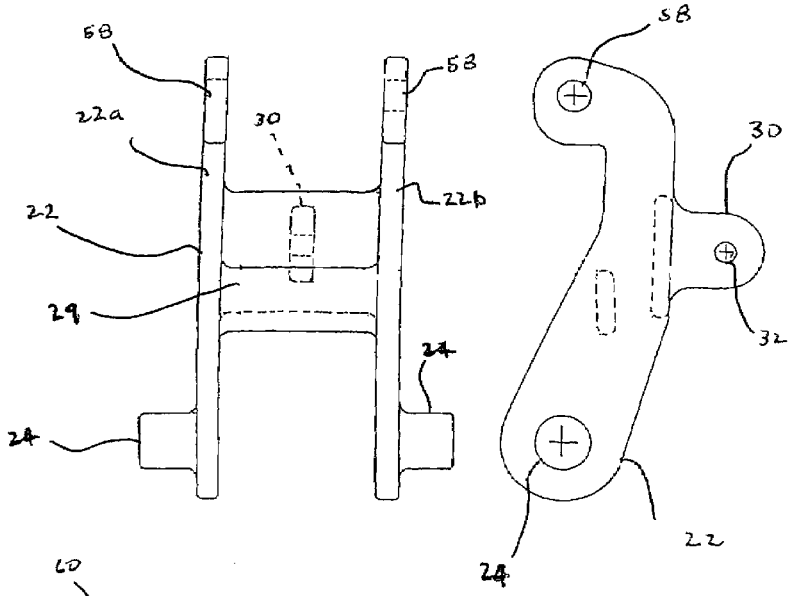
FIGS. 8A–C each show a front and side view of different components of the present invention.
Figure 8A:
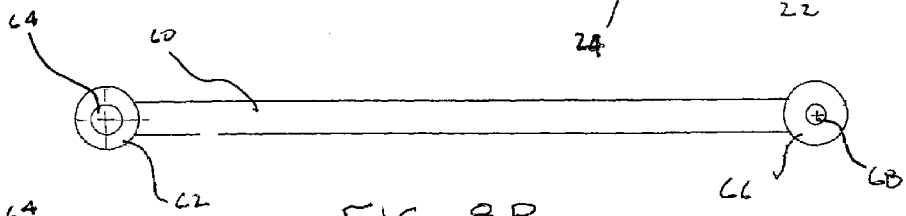

The mechanism of the present invention suited for use on a railway hopper car such as shown in FIG. 1 is most clearly shown in FIGS. 2 and 3. An operating member 22 (FIG. 8A), with a bifurcated section having arms 22*a–b*, is rotatably coupled to a pair of mounts 23, which are affixed to the underside of center sill 6 of car 2, by a pair of extensions or shafts 24 extending outwardly from each arm of member 22. Extending between arms 22*a–b* from a central area 29 of member 22 is a coupling section 30. Section 30 contains an aperture 32. A lever 34 is connected between section 30 and an operating beam 36 by a pair of pins 40.

Figure 8B:
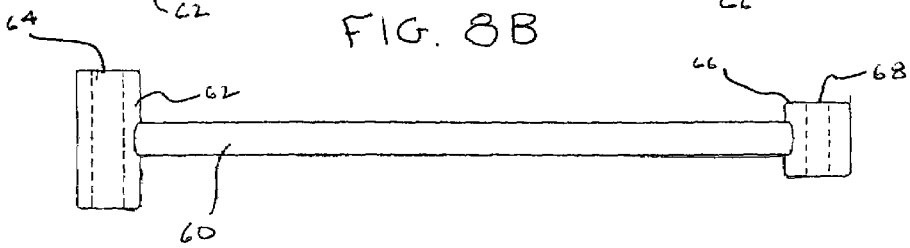
Figure 8B:
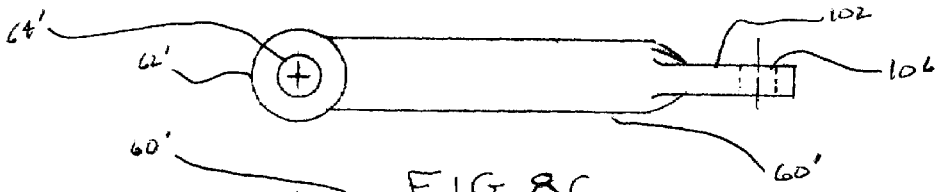

The ends of operating member 22 opposite the end containing shafts 24 each contain an aperture 58 and are each rotatably coupled to a connecting shaft 60 (FIG. 8B) having a cylindrical element 62 containing a through hole 64 at one end and a cylindrical element 66 containing a through hole 68 at its opposite end. Element 62 is rotatably held in position by a pin 70 through apertures 58 of member 22. The opposite end 66 of lever 60 is rotatably coupled to a door spreader 74 of each door 9 by a bifurcated clevis 76 having arms 76*a–b* by a pin 78. Clevis 76 also contains an extended threaded section 80.

Clevis 76 is rotatably coupled to door spreader 74 of each door 9 such that the door actuating mechanism can open each hopper unit 4. Each door 9 has a door spreader 74 affixed thereto by welding or any similar attachment means known in the art. Clevis 76 is coupled to spreader 74 of door 9 by inserting threaded section 78 through an aperture 82 of a bracket 84 attached to door spreader 74 and fastening them together with a nut 88, as can be seen clearly in FIG. 2.

The operation of the door actuating mechanism of the present invention can now be described as follows. Cylinder 8 is coupled to operating beam 36 by lever 34. When cylinder 8 is activated, beam 36 is shifted to the left as shown in FIG. 2, causing lever 34 to push on section 30 of operating member 22. Further movement of beam 36 causes member 22 to rotate about shafts 24, which causes shaft 60 to rotate about pin 70, which couples element 62 of shaft 60 to member 22.

As beam 36 continues to move, the rotation of member 22 about shafts 24 causes shaft 60, which is coupled to door 9, to move to the left as shown in FIG. 2. This rotation causes door 9 to begin to open, as can be seen at arrow A in FIG. 2. Continued movement of beam 36 causes door 9 to open completely as shown at arrow B. The closing of door 9 is accomplished by reversing the movement of beam 36, causing the mechanism to operate in the reverse manner as previously described.

The device of the present invention creates an over center latch for each door, adding a positive safety to the design. Referring now to FIG. 2, when the device of the present invention is in its closed position, an over center latch is created as pin 78 crosses through a plane passing through the centers of extensions 24 and pin 70 which supports shaft 60 in the closed position. As door 9 opens, shaft 60 crosses through this plane, releasing the over center latch and allowing door 9 to shift to the left, as shown at arrow A in FIG. 2. Aided in part by the weight of the material within hopper 4, door 9 opens completely to the position shown at arrow B. Note that door 9 is located a significant distance away from hopper 4 at arrow B, allowing the material within hopper 4 to empty quickly.

Figure 4:
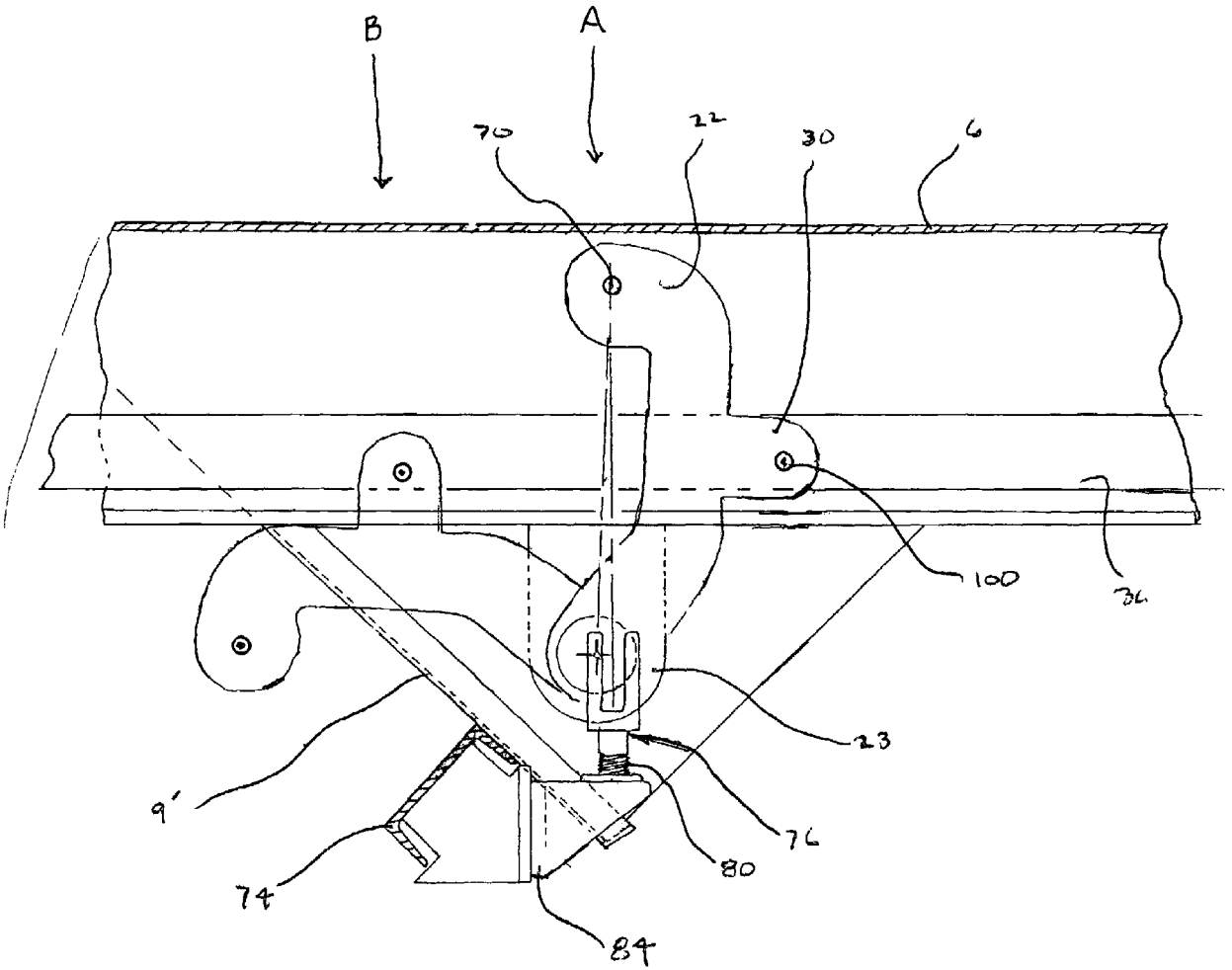
FIG. 4 is a fragmentary elevational view of another embodiment of the actuating mechanism.

FIG. 4 is a representation of the present invention shown on another type of hopper door. The connecting shaft of this embodiment has been removed from FIG. 4 for clarity. Note that throughout the drawings, like elements are designated with like reference numbers.

Figure 8C:
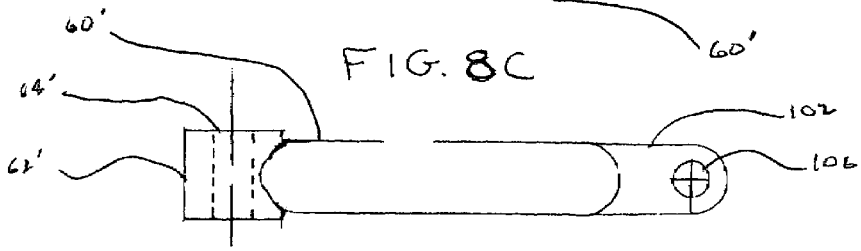

Referring now to FIG. 4, hopper door 9' is shown in its closed position, with member 22 in its over center latch location as shown at arrow A. Coupling section 30 of member 22 is directly fixed to operating beam 36 by a pin 100. As beam 36 is shifted to the left in FIG. 4, member 22 rotates about shafts 24 which are rigidly fixed within mounts 23, and travels to the position shown at arrow B. Connecting shaft 60' (FIG. 8C), which is connected to member 22 by cylindrical end 62' between arms 22*a–b* by pin 70 through aperture 64', and to door 9' at its other end by a flattened extension 102 which fits within clevis 76 and is coupled for rotation by pin 78 through aperture 106, serves to open door 9'. At this position, hopper door 9' is opened completely.

Figure 5A:
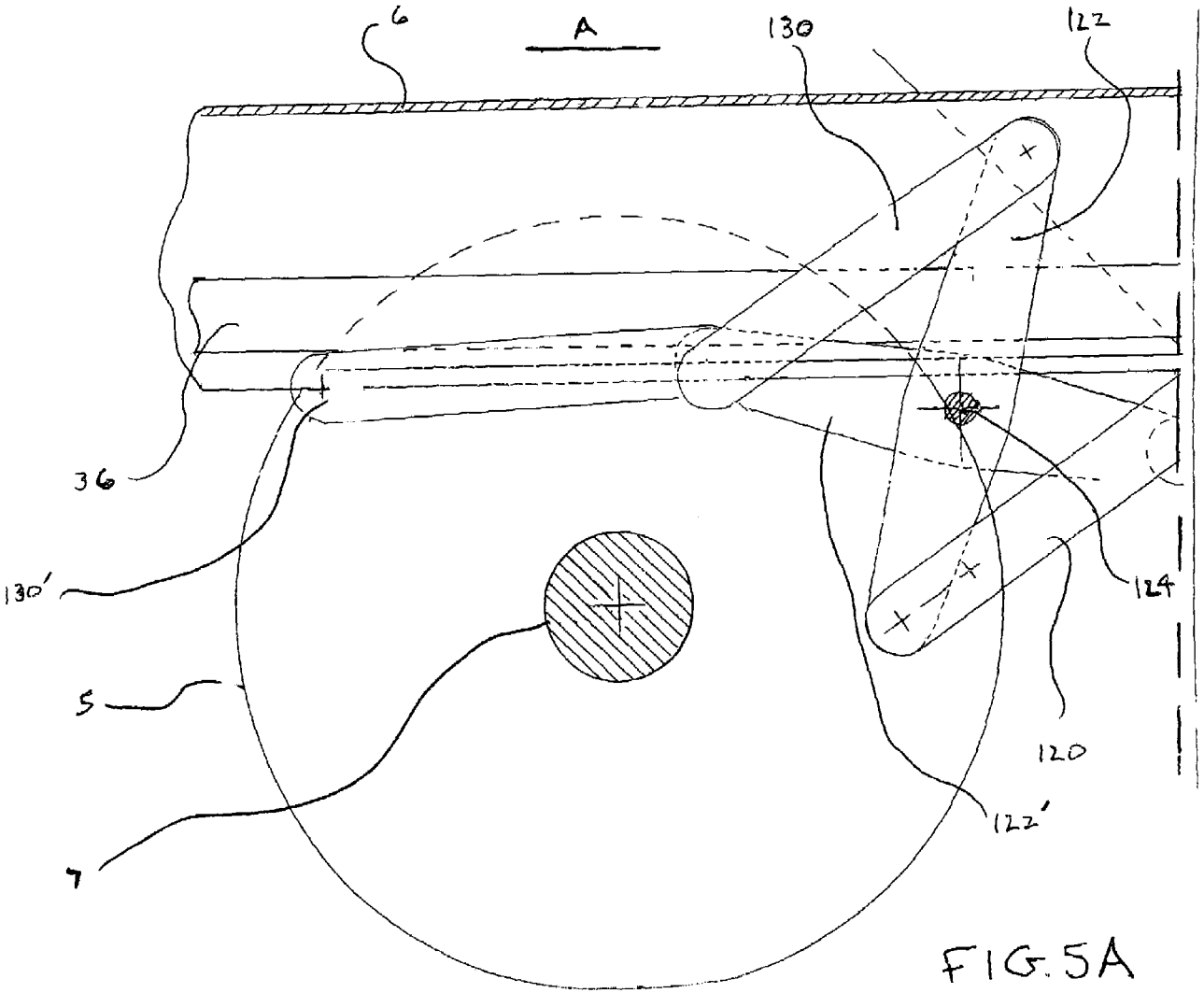
FIGS. 5A–B taken together, is an elevational view, taken along a longitudinal axis of a railroad hopper car having transverse doors, showing the reversing mechanism of the embodiment shown in FIG. 4.
Figure 5B:
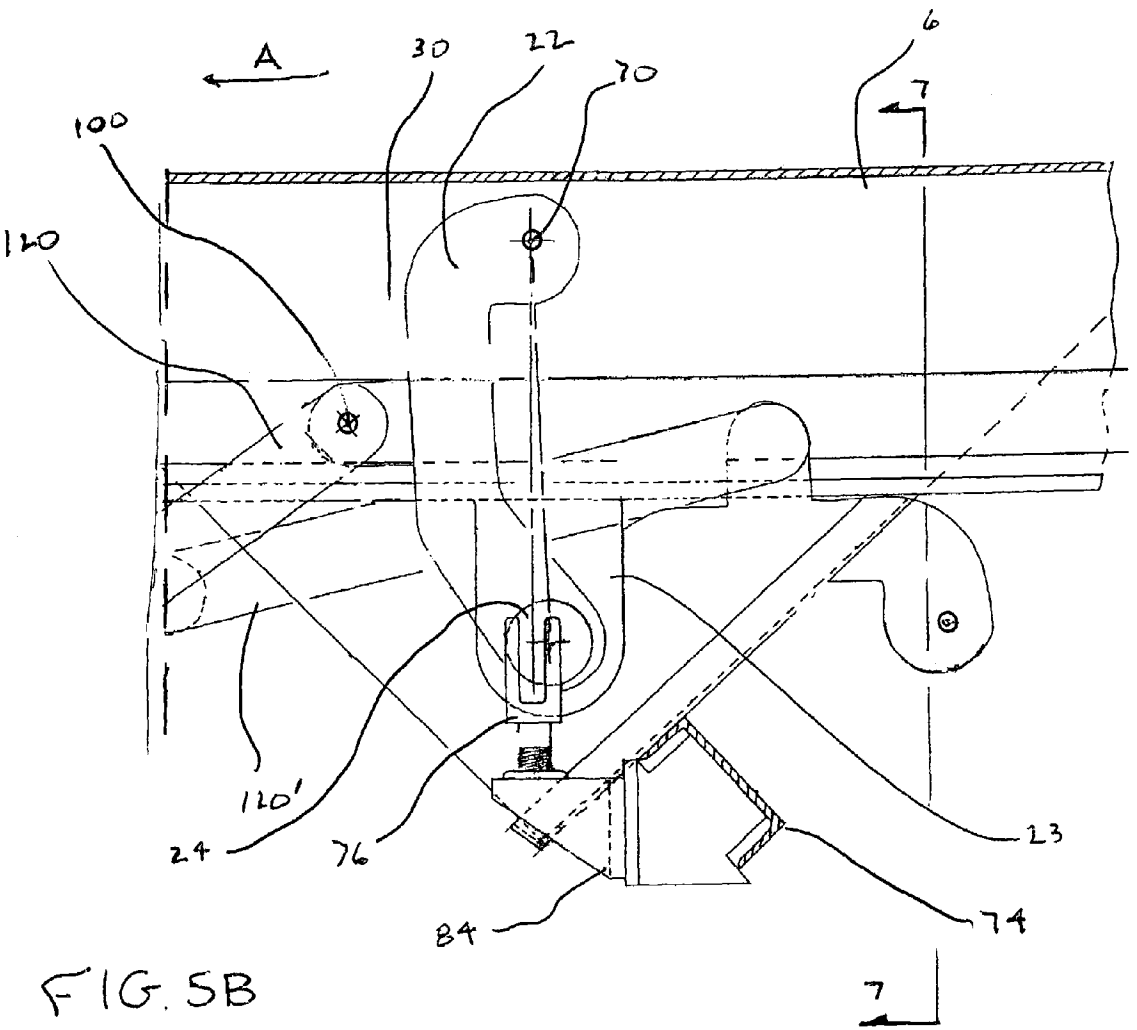
Figure 6A:
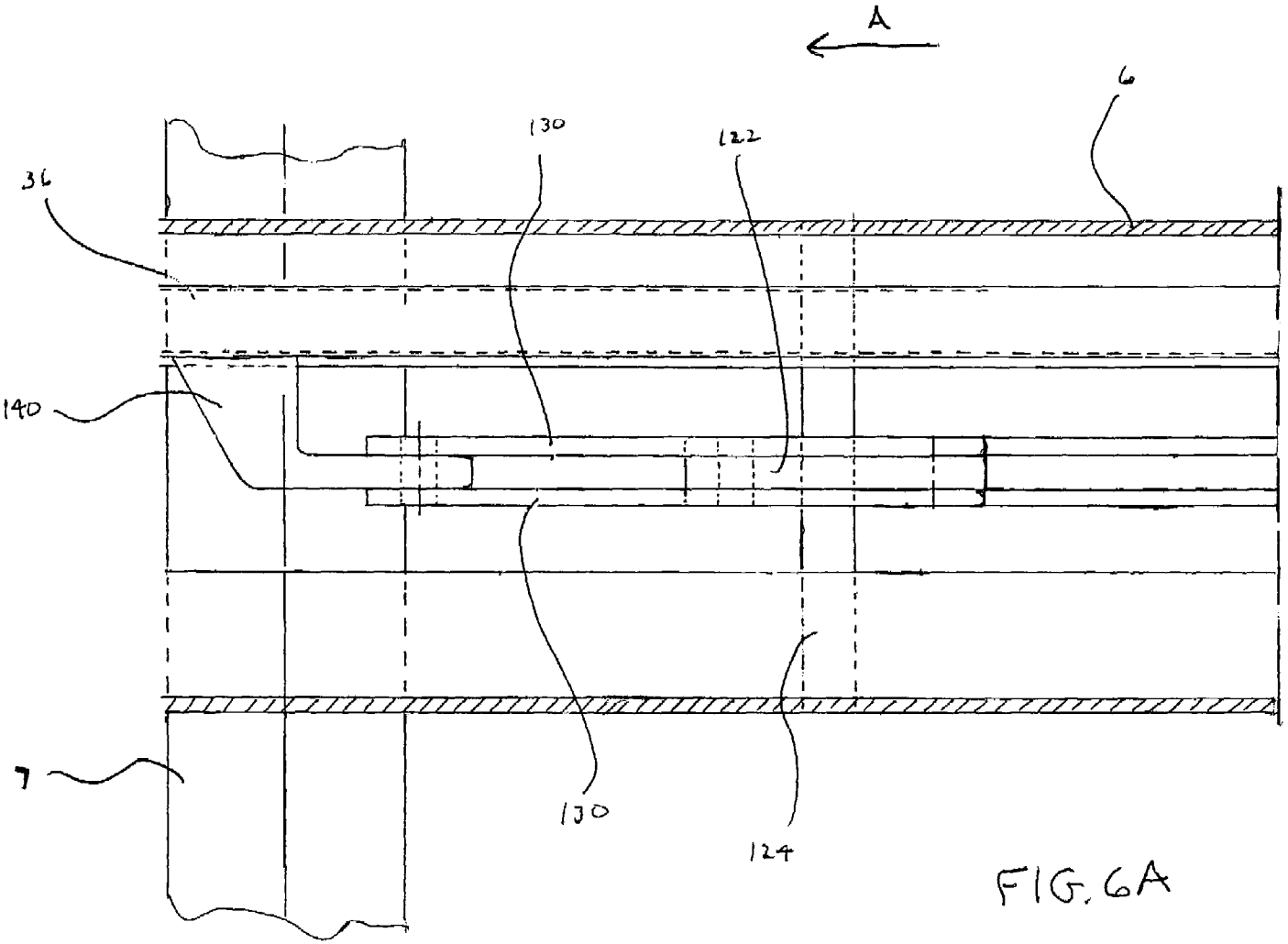
FIGS. 6A–B taken together, is a top view of the mechanism shown in FIGS. 5A–B in the closed position.
Figure 6B:
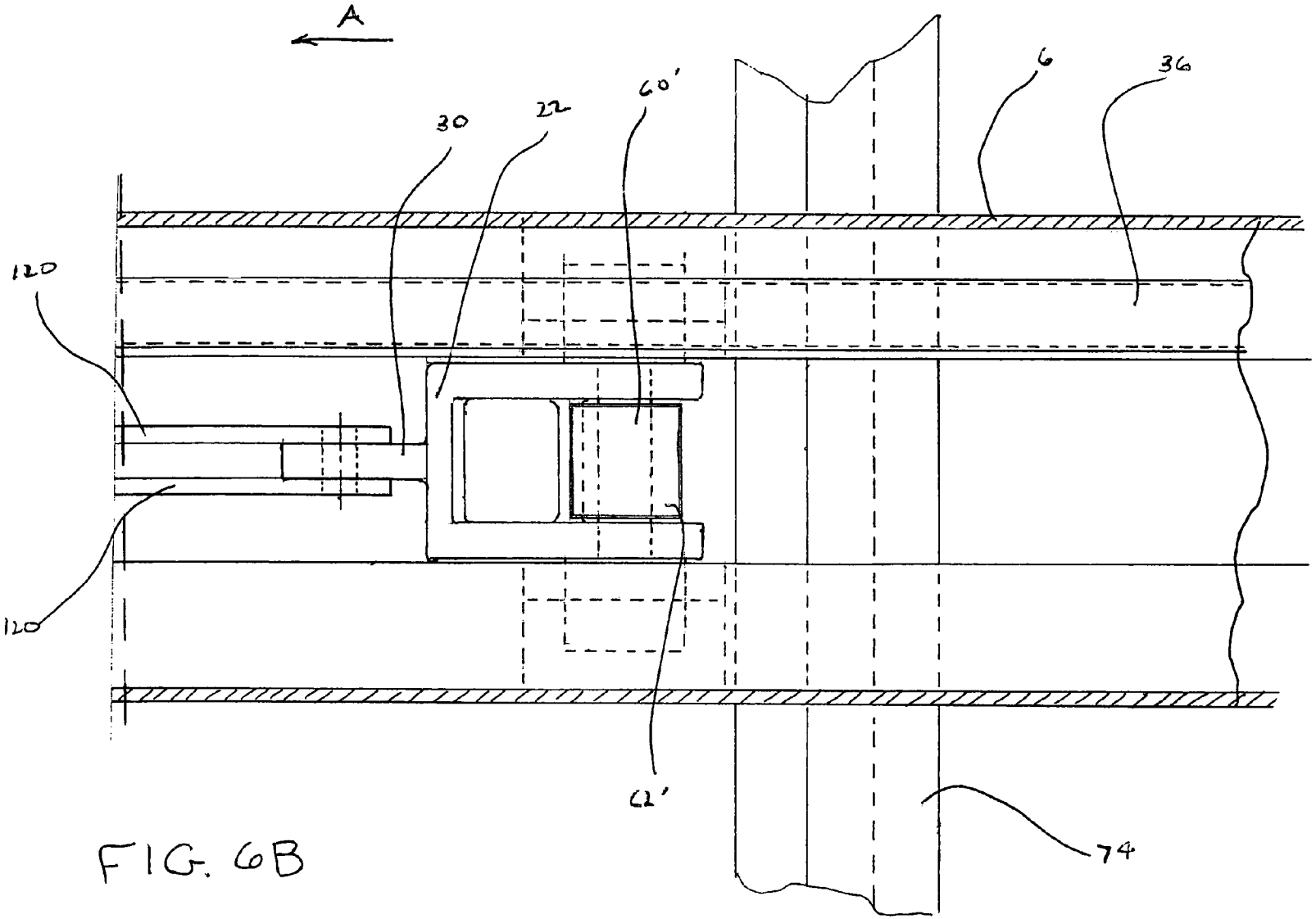
Figure 7:
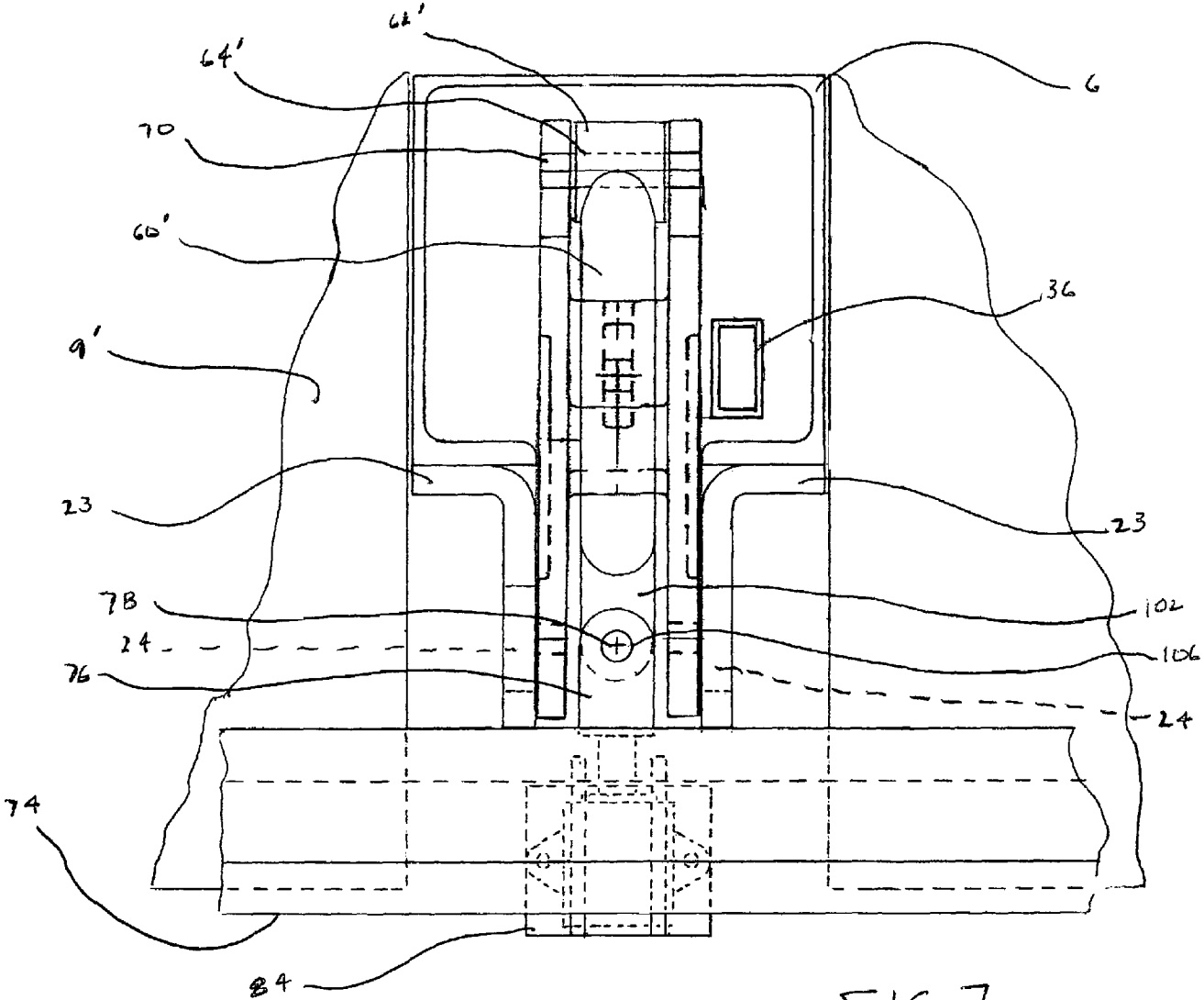
FIG. 7 is a sectional view of the mechanism shown in FIGS. 5A–B taken along line 7—7.

The reversing mechanism of the present invention for actuating doors which operate in the opposite direction as the door shown in FIGS. 2 and 4 is most clearly shown in FIGS. 5–7. Operating member 22 is rotatably coupled by outwardly extending shafts 24 to a pair of extensions 23 which are rigidly affixed to the underside of center sill 6. One end of a pair of levers 120 are rotatably coupled to outwardly extending coupling section 30 of member 22, while a second lever 122 is rotatably coupled between the opposite ends of levers 120. Lever 122 is fixed for rotation in its central region about a shaft 124 which is affixed to a portion of the underside of center sill 6. The opposite end of lever 122 is rotatably coupled between the ends of a pair of third levers 130. The opposite ends of levers 130 are fixed for rotation to operating beam 36 by a fulcrum 140, which is rigidly affixed to operating beam 36.

The operation of the reversing mechanism of the present invention can now be described. When the mechanism is activated by applying power to cylinder 8, operating beam 36, which is coupled to cylinder 8, is shifted from the closed position to open position, in the direction shown by arrow A in FIGS. 5A–B and 6A–B to shift door 9 from its closed position. Fulcrum 140 shifts to the left in FIG. 5A, causing levers 130 to shift to the position shown at 130'. This motion causes lever 122 to rotate counterclockwise about shaft 124 to the position shown at 122'. Levers 120 move in the opposite direction from operating beam 36 to the position shown at 120', causing operating member 22 to rotate clockwise about shafts 24 by virtue of the connection of shafts 120 to outwardly extending portion 30. As shaft 60' shifts through the plane through the centers of pin 70 and extensions 24, the over center latch is released, allowing hopper door 9' to open completely, aided by the weight of the contents in the hopper. The closing of door 9' is accomplished by reversing the travel of operating beam 36.

The device of the present invention can be used in both new car construction and also in retrofitting existing cars. For cars having transverse doors, preferably one mechanism is used for each door. As at least one door opens in the opposite direction, as shown in FIG. 1, the reversing mechanism taught in this invention will be used for doors which operate in reverse.

Figure 9:
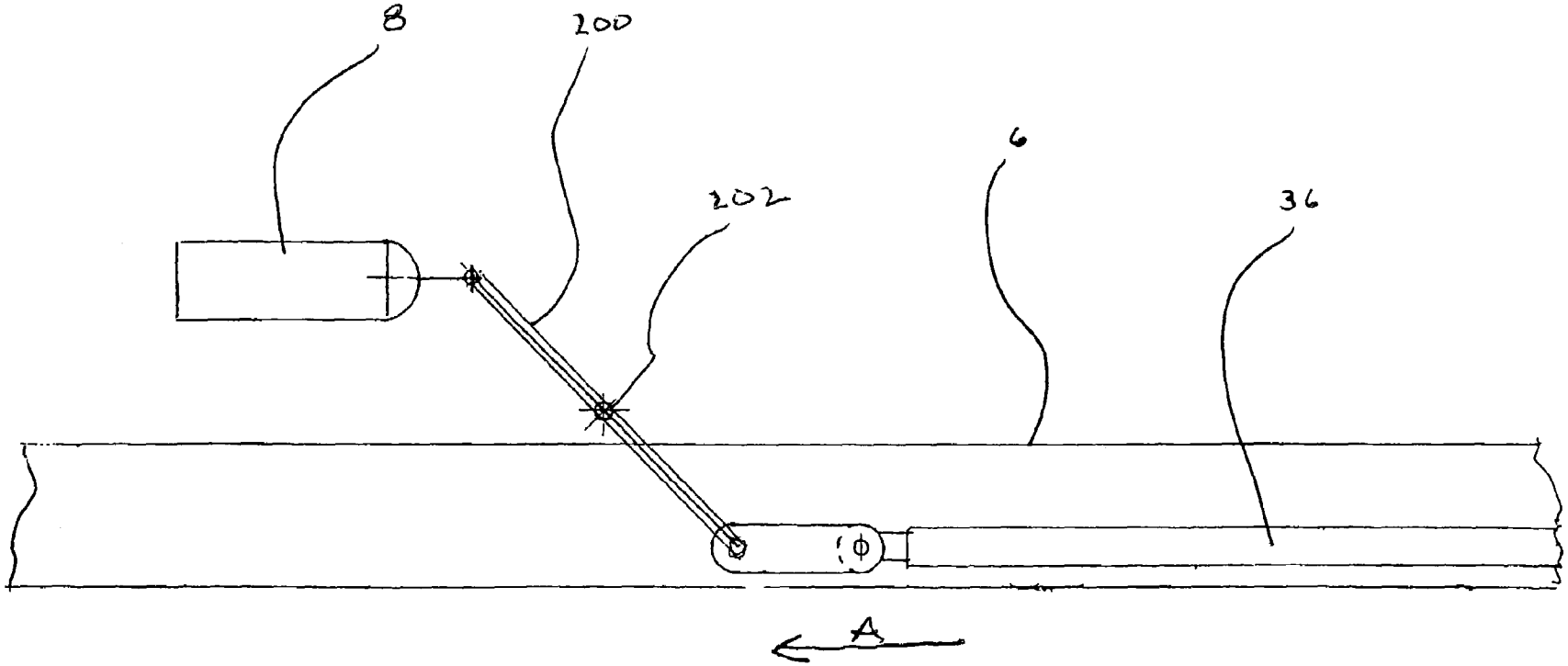
FIG. 9 is an elevational view of an air cylinder of the actuating mechanism shown in FIG. 3.

FIG. 9 shows an air cylinder which can operate the mechanism of the present invention when it is not possible to directly couple the cylinder to the actuating beam. Referring now to FIG. 9, a cylinder 8 is coupled to actuating beam 36 by a lever 200. Lever 200 is fixed for rotation about a pivot 202. When cylinder 8 is activated, lever 200 turns about pivot 202 in a clockwise direction, causing beam 36 to travel in the direction shown by arrow A. Using this mechanism, cylinder 8 can be mounted on either end of car 2, as actuating beam 36 can be made to travel in either direction by using either direct coupling or lever 200.

In the above description, and in the claims which follow, the use of such words as "clockwise", "counterclockwise", "distal", "proximal", "forward", "rearward", "vertical", "horizontal", and the like is in conjunction with the drawings for purposes of clarity. As will be understood by one skilled in the art, the mechanisms will operate on hopper doors which open in opposite directions, and thus will use opposite terminology.

While the invention has been shown and described in terms of a preferred embodiment, it will be understood that this invention is not limited to this particular embodiment and that many changes and modifications may be made without departing from the true spirit and scope of the invention as defined in the appended claims.

What is claimed is:

1. A railroad hopper car having a first end and a second end and having transverse doors for closing the hoppers, comprising:

a body;

a power source;

a plurality of hoppers along the underside of said body;

a plurality of doors situated in a transverse direction to said body for opening and closing said hoppers, said doors rotatable between a first closed position and a second open position, with at least one of said doors rotating in an opposite direction from said other doors when moving from said first closed position to said second open position;

a center sill, affixed to the underside of the hopper car, extending along the length of the car;

a plurality of operating members, each rotatably coupled to said center sill, with each operating member comprising:

a bifurcated first end;

a bifurcated second end having a mounting shaft extending from each bifurcation, with said mounting shafts coupled for rotation to said center sill;

and a central portion connecting said first end and said second end;

a plurality of connecting shafts, each having a first end rotatably coupled between the bifurcation of said first end of said operating member, and a second end coupled to a door;

an actuating beam, coupled between said power source and said central portion of each of said operating members;

and at least one reversing linkage connected to a door, said linkage comprising:

a first lever coupled to at least one of said operating members;

a pivot shaft, fixed to said center sill;

a second reversing lever mounted for rotation about said pivot shaft and coupled to said first lever at one end;

and a third lever rotatably coupled at one end to said second reversing lever and at its other end to said actuating beam;

wherein when said power source is activated, said operating members rotate such that said connecting shafts rotate said doors from said first closed position to said second open position.

2. The car of claim 1, wherein said actuating beam is located within said center sill.

3. The car of claim 1, wherein said power source comprises and air cylinder.

4. The car of claim 1, wherein said power source is located at said first end of said railroad hopper car.

5. The car of claim 1, wherein said power source is located at said second end of said railroad hopper car.

6. The car of claim 1, wherein the cooperation between each operating member and said corresponding connecting shaft in the closed position creates an over center latch to positively lock the door.

7. A mechanism for actuating doors of a hopper car, said car being equipped with a power source, a center sill affixed to the underside of the car extending the length of the car, an actuating beam coupled to said power source, and having a plurality of transverse doors rotatable between a closed position and an open position for covering the hoppers, with at least one of said doors traveling in the opposite direction when moving from said closed position to said open position, said mechanism comprising:

a plurality of operating members, each rotatably coupled to the center sill of the car;

a plurality of connecting shafts, each having a first end coupled between each of said operating members and a second end coupled to a corresponding transverse door closing a hopper of the car, wherein none of the connecting shafts are coupled between doors from adjacent hoppers;

and at least one reversing linkage, connected to at least one transverse door, said linkage comprising:

a first lever coupled to at least one of said operating members;

a pivot shaft, fixed to said center sill;

a second reversing lever mounted for rotation about said pivot shaft and coupled to said first lever at one end;

and a third lever, coupled at one end to said second reversing lever and at its other end to said actuating beam;

wherein when the power source is activated said actuating beam shifts, causing said operating members rotate such that said shafts rotate said transverse doors from said closed position to said open position.

8. The mechanism of claim 7, wherein said operating member comprises:

a first end rotatably coupled to said door by said shaft;

a second end fixed for rotation to said center sill;

and an extension, located between said first and second ends, coupled to said actuating beam.

9. The mechanism of claim 8, wherein said first end of each operating member consists of a first bifurcated section for rotatably coupling the first end of a connecting shaft between said bifurcations.

10. The mechanism of claim 8, wherein said second end of each operating member consists of a second bifurcated section having outwardly extending mounting shafts which are rotatably coupled to said center sill.

11. The mechanism of claim 8, wherein each operating member and corresponding connecting shaft operate as an over center latch to aid in the closing of the door.

12. A mechanism for actuating doors of a hopper car, said car being equipped with a power cylinder, a center sill affixed to the underside of the car extending the length of the car, an actuating beam coupled to the power cylinder, and having a plurality of transverse doors for covering the hoppers rotatable between a closed position and an open position, with at least one of said doors traveling in the opposite direction when moving from said closed position to said open position, said mechanism comprising:

a plurality of operating members, each rotatably coupled to the center sill, with each operating member comprising:

a bifurcated first end;

a bifurcated second end having a mounting shaft extending from each bifurcation, with said mounting shafts rotatably coupled to the center sill;

and a central portion connecting said first end and said second end, with said central portion being coupled to said actuating beam;

a plurality of connecting shafts, each having a first end rotatably coupled between the bifurcations of said first end of said operating member, and a second end coupled to a transverse door;

and at least one reversing linkage, connected to a door, said linkage comprising:

a first lever coupled to the central portion of at least one of said operating members;

a pivot shaft, fixed to the center sill;

a second reversing lever mounted for rotation about said pivot shaft and coupled to said first lever at one end;

and a third lever, rotatably coupled at one end to said second reversing lever and at its other end to the actuating beam;

wherein when said power cylinder is activated, said operating members rotate such that said connecting shafts rotate the doors from said first closed position to said second open position.

13. The mechanism of claim 12, each of said operating members and its respective connecting shaft acts to serve as an over center latch when the transverse door is in the closed position.

* * * * *